United States Patent [19]

Derichs et al.

[11] 4,133,492

[45] Jan. 9, 1979

[54] CLOSED PNEUMATIC LOAD-APPLYING DEVICE FOR THREAD BRAKES

[75] Inventors: Josef Derichs; Gerhard Koslowski, both of Mönchen-Gladbach, Germany

[73] Assignee: W. Schlafhorst & Co., Mönchen-Gladbach, Germany

[21] Appl. No.: 874,891

[22] Filed: Feb. 3, 1978

[30] Foreign Application Priority Data

Feb. 5, 1977 [DE] Fed. Rep. of Germany ..... 2704874

[51] Int. Cl.[2] ..... B65H 59/10

[52] U.S. Cl. ..... 242/150 R; 242/147 A; 340/605; 340/679

[58] Field of Search ..... 242/150 R, 147–156.2, 242/45, 75, 75.2, 75.3, 75.4, 36, 49, 57, 129.8, 131, 131.1; 340/239, 240, 242, 259; 73/40; 116/70, 114 P, 114

[56] References Cited

U.S. PATENT DOCUMENTS

| | | | |
|---|---|---|---|
| 2,888,216 | 5/1959 | Simons, Jr. et al. | 242/45 |
| 3,365,710 | 1/1968 | Duplessy | 340/242 |
| 3,533,574 | 10/1970 | Cooper et al. | 242/150 R |
| 3,731,295 | 5/1973 | Van Luyn | 340/242 |
| 3,819,097 | 6/1974 | Stritzko | 242/150 R X |
| 3,935,567 | 1/1976 | Reynolds | 340/242 |
| 4,049,935 | 9/1977 | Gruber | 340/242 X |

FOREIGN PATENT DOCUMENTS

| | | | |
|---|---|---|---|
| 452714 | 11/1948 | Canada | 242/150 R |
| 742895 | 1/1956 | United Kingdom | 242/150 R |

*Primary Examiner*—Stanley N. Gilreath
*Attorney, Agent, or Firm*—Herbert L. Lerner

[57] ABSTRACT

Assembly includes a closed pneumatic device for applying a load to a thread brake for braking a thread traveling therethrough, the load-applying device including means for storing pressure at a variable volume, and means operatively connected to the closed pneumatic load-applying device for determining and signaling a detrimental pneumatic leakage loss in the load-applying device.

5 Claims, 3 Drawing Figures

CLOSED PNEUMATIC LOAD-APPLYING DEVICE FOR THREAD BRAKES

Figure 1:
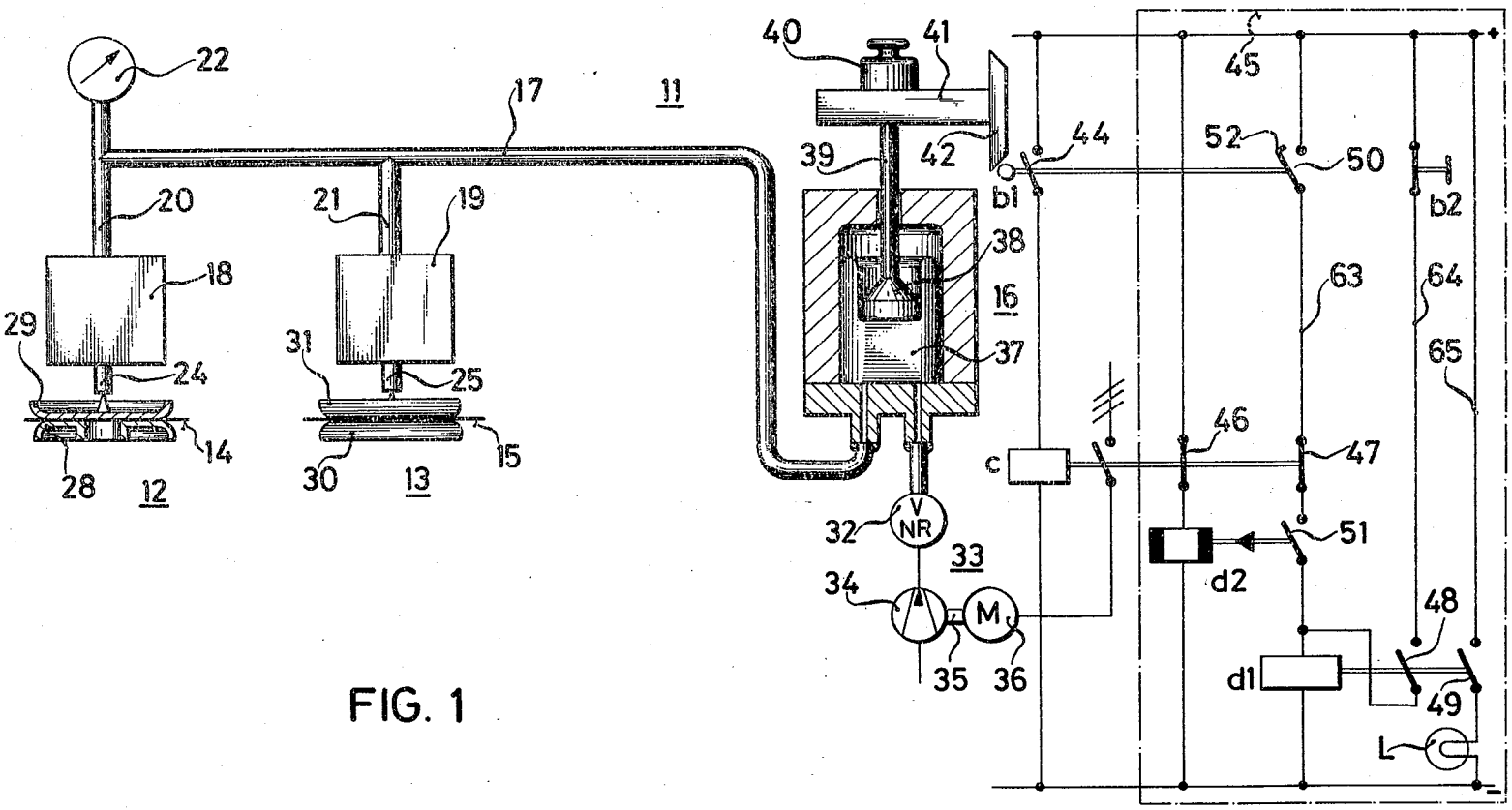

The invention relates to a closed pneumatic load-applying device for thread brakes and, more particularly, to such a device having a pressure storage at variable volume.

Pneumatic load-applying devices are used if the loading is to be centrally set or adjusted and controlled for a plurality of thread brakes. This is the case, for example, in a bobbin creel.

It has become known heretofore to monitor pressure in pneumatic load-applying devices and to signal an impermissible drop in the pressure. The signaling occurs at a considerably later point in time, namely, when the threads which are in motion must actually be stopped because the loading applied to the thread brakes has become inadequate.

It is accordingly an object of the invention to provide a closed pneumatic load applying device for thread brakes in an assembly wherein there is no waiting at all until the pressure drops, but rather, while the pressure remains adequate, attention is drawn to a leak, that has not yet been localized, brfore a pressure drop appears.

With the foregoing and other objects in view, there is provided, in accordance with the invention, an assembly comprising a closed pneumatic device for applying a load to a thread brake for braking thread traveling therethrough, the load-applying device including means for storing pressure at a variable volume, and means operatively connected to closed pneumatic load-applying device for determining and signaling a detrimental pneumatic leakage loss in the load-applying device.

In accordance with another feature of the invention, the determining and signaling means include a device for monitoring volume reduction in the pressure storing means.

In accordance with afurther feature of the invention, the monitoring device includes means for comparing a measured volume reduction in the pressure storing means with a normal value thereof, and means for issuing a signal in response to a determination by the comparing means that the measured volume reduction exceeds the normal value of volume reduction.

In accordance with an additional feature of the invention, the determining and signaling means include an adjustable electrical time-limit relay for monitoring length of time of reduction of a volume of given size in the pressure storing means.

In accordance with a concomitant feature of the invention, the load-applying device includes a volume regulator operatively connected to the pressure storing means and a pressure source connectible at switching intervals to the pressure storing means, and the determining and signaling means include a device for monitoring time portions of the switching intervals characteristic of rate of volume reduction of the pressure storing means.

As long as no leakage location of detrimental size is present in the closed pneumatic load-applying device of the invention, the reduction in volume in the pressure storage device remains within permissible tolerance limits. The contents of the pressure storage device can then be refilled from time to time without having to look for leakage locations. Only if, due to a leak of detrimental size, a considerable and, especially, an accelerated volume reduction occurs in the pressure storage device, does the assembly of the invention in the instant application initiate a signal.

With the presence of a pressure source connectible at switching intervals to the pressure storage device, these switching intervals become briefer with increase in the leakage. A characteristic time portion of the switching intervals is the switching-off time period or duration of the pressure source. If the overflow speed or rate during the switching-on time period of the pressure source is only minimal, monitoring the switching-on time period as a characteristic time portion of the switching interval is recommended. With an increase in the leakage or leak locations, this switching-on time period is lengthened. It is also possible to monitor the switching-on as well as the switching-off time periods simultaneously or in common, whereby monitoring of the entire switching interval is produced.

The invention of the instant application offers the advantage that attention is drawn to increased leakage losses before a pressure drop can occur in the pressure storage device. In this regard, monitoring of a detrimental leakage loss can also be effected in several stages, two or more of the assemblies according to the invention being installable for parallel operation, respectively, set for lesser and greater volume reductions in the pressure storage device. Thus, monitoring is achieved which affords one or more forewarning signals and a final warning signal.

Other features which are considered as characteristic for the invention are set forth in the appended claims.

Although the invention is illustrated and described herein as embodied in a closed pneumatic load-applying device for thread brakes, it is nevertheless not intended to be limited to the details shown, since various modifications and structural changes may be made therein without departing from the spirit of the invention and within the scope and range of equivalents of the claims.

Figure 3:
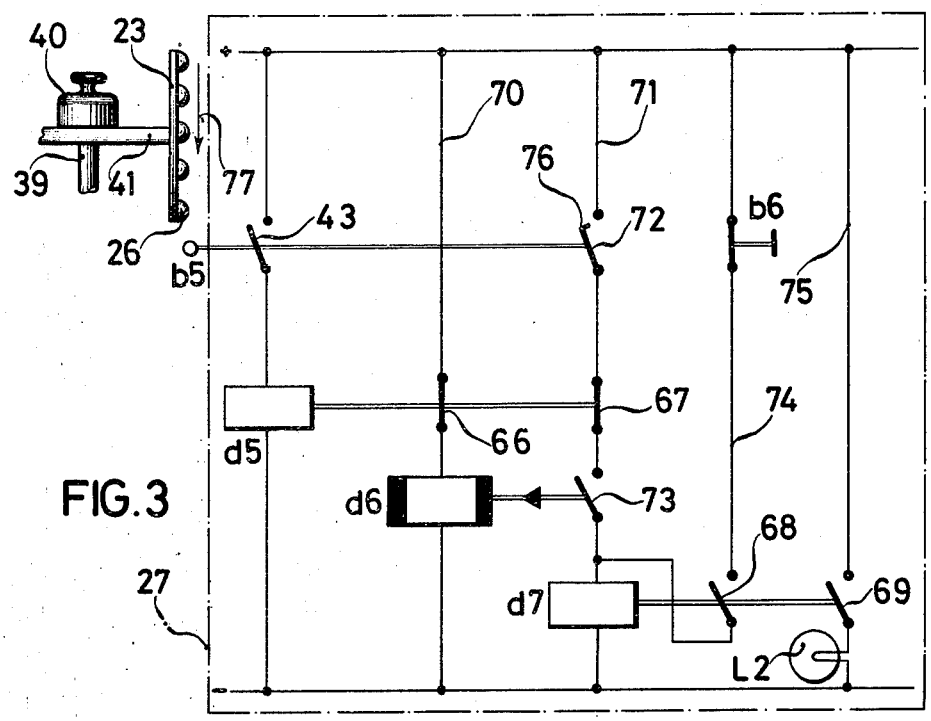
Figure 2:
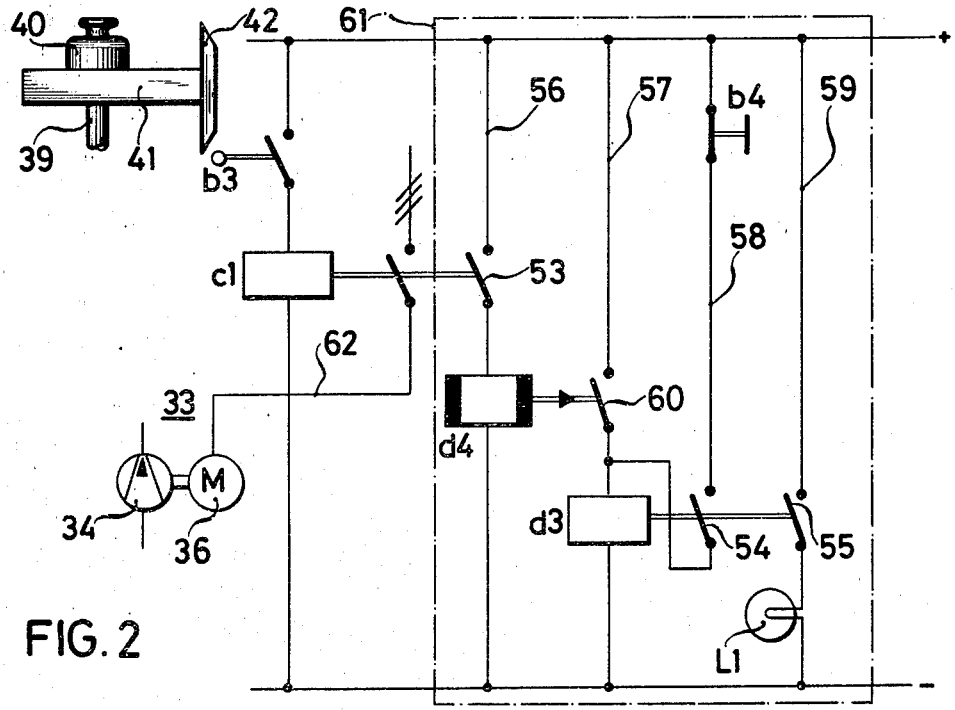

The construction and method of operation of the invention, however, together with additional objects and advantages thereof will be best understood from the following description of specific embodiments when read in connection with the accompanying drawings, in which:

FIG. 1 is a diagrammatic, partly schematic, view of a closed pneumatic load-applying device for thread brakes together with a device for determining and signaling a detrimental leakage loss through monitoring the switch-off time duration of the pressure source for the pneumatic load-applying device;

FIG. 2 is a schematic view of another embodiment of the device for determining and signaling a detrimental leakage loss according to FIG. 1, wherein the determining and signaling are effected through monitoring the switch-on time duration of the pressure source; and FIG. 3 is a schematic view of yet another embodiment of the detrimental leakage loss determining and signaling device which directly monitors volume reduction of pressure storage in the pneumatic load-applying device and issues a signal if this volume reduction occurs too rapidly.

Referring now to the drawing and first, particularly, to FIG. 1 thereof, there is shown diagrammatically a closed pneumatic load-applying device 11 for thread or yarn brakes 12 and 13. By means of a non-illustrated winding device, a thread 14 is drawn through the thread brake 12, and a thread 15 through the thread-brake 13. The pneumatic load-applying device 11 includes a pressure reservoir or storage device 16 from which a manifold 17 leads to conventional pressure transmitters 18 and 19 which are connected by respective connecting lines 20 and 21 to the manifold 17. A pressure indicator 22 is located at the end of the manifold 17. The pressure transmitter 18 acts upon a plunger 24, and the pressure transmitter 19 upon a similar plunger 25. The thread brake 12 includes a lower plate 28 and an upper plate 29, as viewed in FIG. 1, the plunger 24 exerting thread-braking pressure upon the upper plate 29, and the thread brake 13 includes a lower plate 30 and an upper plate 31 upon which the plunger 25 acts.

The pressure storage device 16 is connected through a check valve 32 to a pressure source 33. The pressure source 33 is formed of a compressor 34 which is connected by a shaft 35 to an electric motor 36. A roller membrane 37 is disposed in the interior of the pressure storage device 16 and is subjected to a loading weight or counterweight 40 applied through a disk or plate 38 of an outwardly projecting plunger 39. A switching cam 42 is fastened by a strap 41 to the plunger 39. Upon a volume reduction in the pressure storage device 16, the switching cam 42 acts upon a cam switch b1 having a contact member 44 so as to make or close contact with the latter and thereby actuate a magnetic relay switch c which switches on the electric motor 36. When the electric motor 36 is running, the compressor 34 feeds compressed air in the pressure storage device 16 through the check valve 32 until the switching cam 42 again breaks or opens the contact previously made with the cam switch b1.

The closed pneumatic load-applying device 11 is associated with a device 45 for monitoring the switched-off time period or duration of the pressure source 33. The volume-reduction of the pressure storage device 16 is thereby monitored. The monitoring device 45 includes a timing relay d2 with conventional attraction delay. This timing or time-delay relay d2 is always switched on by an auxiliary contact 46 of the relay switch c when the relay switch c for energizing the motor 36 is switched off or has broken contact.

A line 63 extends from a positive busbar (+) serially through an auxiliary contact 50 of the cam switch b1, an auxiliary contact 47 of the relay switch c, a contact member 51 of the time-delay relay d2 and a coil of an auxiliary magnetic relay switch d1 to a negative busbar (−). The auxiliary relay switch d1 has an auxiliary contact 48 which operates as a holding contact and is located in a circuit 64 wherein a manually actuatable shut-off control switch b2 is connected. The auxiliary switch d1 has a second auxiliary contact 49 for a circuit 65 of a signaling device L constructed as a signal lamp.

FIG. 1 of the drawing shows the cam switch b1, the magnetic relay switch c and the auxiliary relay switch d1 in switched-off or noncontact condition. The time-delay relay d2 is switched through the auxiliary contact 46 of the relay switch c. This condition has already lasted so long that the switch member 51 has opened or broken the contact thereof after expiration of the attraction delay time period set at the time-delay relay d2. The auxiliary contact 47 of the relay switch c is closed, and the auxiliary contact 50 of the cam switch b1 is opened. The auxiliary contact 50 has a switch-off time delay and/or switch-on time lead which is indicated symbolically by a small hook 52 shown thereon.

Upon a volume reduction of the pressure storage device 16, the relay switch c is switched on through the cam switch b1 and, due to switching-on of the electric motor 36, connects the pressure source 33 to the pressure storage device 16. The instant the magnetic relay switch c becomes magnetically attractive, the auxiliary contacts 46 and 47 thereof are opened. Beforehand, the auxiliary contact 50 of the cam switch b1 is closed with switch-on lead time. After the auxiliary contact 46 has opened, the time-delay relay d2 is switched off and consequently closes or effects contact by the switch member 51 without delay or with slight delay. In the interim the auxiliary contact 47 has already opened, however, so that there has been no change in the switching condition of the auxiliary relay switch d1. The pressure storage device 16 is then filled by means of the pressure source 33. After the pressure storage device 16 has become filled, the switching condition represented in FIG. 1 is again assumed with the exception that the switch member 51 of the time-delay relay d2 still remains closed, initially, until the set magnetically attractive time-delay period has run out or expired. This magnetically attractive time-delay period is of such length that, when a given switch-off time period of the relay switch c or the cam switch b1 is less than this length of time, this contact or switch member 51 remains closed even if switching-on of the cam switch b1 occurs anew. In this case, the auxiliary contact 50 is already closed, because of the switch-on lead time, before the auxiliary contact 47 has opened, so that the auxiliary relay switch d1 effects closing or making contact by the auxiliary contacts 48 and 49 thereof before the relay switch c has switched on. Through the auxiliary contact 48, the auxiliary relay d1 is then held in switched-on condition, and the signal device L is switched-on through the auxiliary contact 49. The signal device L remains switched on until the switch-off control switch b2 is manually actuated.

In the view of the second embodiment of the invention shown in FIG. 2, there is again shown the plunger 39, the load-applying weight 40, the strap 41, the switching cam 42 as well as a cam switch b3 and a relay switch c1. The relay switch c1 switches on the electric motor 36 of the pressure source 33 and has an auxiliary contact 53 which is connected into a circuit 56 of a time-delay relay d4. The timing relay d4 possesses an attractive time-delay for the switch member 60. The switch member 60 of the timing relay d4 is connected into a circuit 57 of an auxiliary magnetic relay switch d3. The auxiliary relay switch d3 has auxiliary contacts 54 and 55. The auxiliary contact 54 is connected as a holding contact into a circuit 58, wherein a shut-off control switch b4 is also provided. The auxiliary contact 55 is connected into the circuit 58 of a signaling device L1. The signaling device L1 is made up of a signal lamp.

The auxiliary contact 53 of the relay switch c1, the timing relay d4, the auxiliary relay switch d3, the shut-off control switch b4 and the signaling device L1 are combined into a device 61 for monitoring the switch-on time duration of the pressure source 33. This device thus also indirectly monitors the volume reduction of the pressure storage device 16.

FIG. 2 shows the cam switch b3, the relay switch c1, the timing relay d4 and the auxiliary relay switch d3 in the switched-off condition. The instant a volume reduction occurs in the pressure vessel 16, the cam switch b3 is switched on and, in turn, switches on the relay switch c1, so that the electric motor 36 is energized over the lead 62. At the same instant, the auxiliary contact 53 of the relay switch c1 is switched on or closed, which closes the circuit 56 and results in the switching on of the timing relay d4. The switch member 60 of the timing relay d4 closes with adjusted attractive delay time period. If the switch-on time period of the relay switch c1 is short, the auxiliary contact 53 opens before the switching member 60 is closed or switched on. In this case, the switching condition of the auxiliary relay switch d3 remains unchanged. If the attractive delay time period of the timing relay d4 is exceeded, however, the switching member 60 closes, so that the auxiliary relay switch d3 is switched on and the contacts 54 and 55 thereof close. Both of these contacts 54 and 55 remain closed until the shut-off control switch b4 is manually actuated independently of whether or not the switching member 60 had been switched-off or opened again in the interim. Whenever the auxiliary contact 53 is opened or switched off, the switching member 60 of the timing relay d4 is opened or switched off without delay. Assurance is thus provided that the signaling device L1 is responsive only when an adjustable switch-on time period of the pressure source 33 is exceeded.

If the switch-on time period of the pressure source 33 is only very brief during undisrupted operation, the device according to FIG. 2 is less recommendable, because the tolerances in the setting or adjustment of the delay time of the timing delay d4 work out unfavorably. Contrarily, if the switch-on time duration of the pressure source 33 is long in comparison to the duration of the switch-off time during undisrupted normal operation, the device according to FIG. 2 is employable advantageously, because the aforementioned disadvantage then disappears and because the cam switch b3 requires no auxiliary contact.

In the third embodiment of the invention shown in FIG. 3 there are again provided the plunger 39, which protrudes out of the pressure-storage device 16 (not shown in FIG. 3), the load-applying weight or counterweight 40 and the strap 41. A vertically disposed strip or rail 23, as viewed in FIG. 3, is mounted on the strap 41 and has several similar cams 26 secured thereto. Whenever a volume reduction of the pressure storage device 16 (FIG. 1) occurs, these cams 26 act upon a cam switch b5 of a device 27 for monitoring volume reduction of the pressure storage device 16. The device 27 includes an auxiliary relay switch d5 which is switchable on and off by means of a contact 43 of the cam switch b5. The auxiliary relay switch d5 has two auxiliary contacts 66 and 67. The auxiliary contact 66 is connected into the circuit 70 of a time-limit relay d6. This time-limit relay d6 always gets switched on when the auxiliary relay d5 switches off. A line 71 extends from the positive busbar (+) through an auxiliary contact 72 of the cam switch b5, through the auxiliary contact 67 of the auxiliary relay d5, through the switch member 73 of the time-limit or timing relay d6 and through the coil of an auxiliary relay switch d7 to the negative busbar (−). The auxiliary relay switch d7 has an auxiliary contact 68, which operates as a holding contact, and is connected into a circuit 74 into which a manually actuatable shut-off control switch b6 is also connected. The auxiliary relay switch d7 has a second auxiliary contact 69 for a circuit 75 of a signaling device L2 which is constructed as a signal lamp.

FIG. 3 shows the cam switch b5 and the auxiliary relay switches d5 and d7 in switched-off condition. The time-limit relay d6 is switched on through the auxiliary contact 66 of the auxiliary relay switch d5. This condition has lasted so long already that the switching member 73 thereof has opened or broken its contact after an attractive delay time period set at the time-limit relay d6 has expired. The auxiliary contact 67 of the auxiliary relay switch d5 is closed, and the auxiliary contact 72 of the cam switch b5 is opened. This auxiliary contact 72 has a switch-off time delay and/or switch-on time lead which is indicated symbolically by a small hook 76 shown thereon.

Upon a volume reduction of the pressure storage device (FIG. 1), the cam switch b5 is switched on through engagement by the lowermost cam 26 of the rail 23, thereby, in turn, switching on the auxiliary magnetic relay d5. The instant the magnetic relay switch d5 becomes magnetically attractive, the auxiliary contacts 55 and 67 thereof are opened. Beforehand, the auxiliary contact 72 of the cam switch b5 has become closed with switch-on lead time. After the auxiliary contact 66 has opened, the time-limit or time-delay relay d6 switches off and consequently closes or effects contact by the switch member 73 without delay or with slight delay. In the interim, the auxiliary contact 67 has already opened, so that there has been no change in the switching condition of the auxiliary relay switch d7.

Upon farther travel of the rail 23 in direction of the arrow 77 shown in FIG. 3 as a result of further volume reduction of the pressure storage device 16 (FIG. 1), the cam switch b5 reaches a postion beyond the operating range of the lowermost cam 26 of the rail 23. Then, the cam switch b5 again switches off, the switching condition shown in FIG. 3 being thereby reset except that the switch member 73 of the time-limit relay d6 still remains closed initially until the set or adjusted attractive delay time period has run out. This attractive delay time period is of such length that during a time interval less than a given duration, this contact by the switch member 73 remains closed when switching-on of the cam switch b5 anew occurs due to the next succeeding cam 26 of the rail 23. In this case, the auxiliary contact 72 is already closed, because of the switch-on lead time, before the auxiliary contact 67 of the auxiliary relay switch d5 has opened, so that the auxiliary relay switch d7 is switched on and the auxiliary contacts 68 and 69 thereof are closed, before the auxiliary relay switch d5 opens the auxiliary contacts 66 and 67 thereof. Through the auxiliary contact 68, the auxiliary relay switch d7 is then held in switched-on condition and, through the auxiliary contact 69, the signaling device L2 is switched on. The latter remains switched on until the shut-off control switch b6 is manually actuated.

If the delay time period or duration set at the time-limit relay d6 is exceeded, however, nothing changes in the switching condition of the time-limit relay d6 and of the auxiliary relay switch d7 during the next succeeding actuation of the cam switch b5. The signaling device L2 is always responsive only when the volume reduction of the pressure storage device 16 occurs too rapidly.

With respect to the diagrammatically illustrated movable brake plates, switches and contacts in the drawing, it should be noted that, although not illustrated, each thereof is presumably provided with suitable restoring devices such as springs for resetting the respective brakes plates, switches and contacts into the normal positions thereof after the respective mechanical or magnetic forces that had been applied thereto are removed. It is furthermore noted that the three short, inclined parallel lines disposed transversely across the line representing the circuit of the motor 36 in FIGS. 1 and 2 symbolically represents a three-phase alternating current source connection thereto.

As mentioned hereinbefore, the invention of the instant application is not limited to the embodiments described and illustrated herein. A pressure vessel at very high pressure can serve alternatively as the pressure source. Furthermore, instead of operating the system with excess pressure, it can alternatively be operated with negative pressure or vacuum. Finally, filling of the pressure storage device 16 can be effected manually from time to time at irregular time intervals with the embodiment of FIG. 3.

There is claimed:

1. Assembly comprising a closed pneumatic device for applying a load to a thread brake for braking a thread traveling therethrough, said load-applying device including means for storing pressure at a variable volume, and means operatively connected to said closed pneumatic load-applying device for determining and signaling a detrimental pneumatic leakage loss in said load-applying device.

2. Assembly according to claim 1 wherein said determining and signaling means include a device for monitoring volume reduction in said pressure storing means.

3. Assembly according to claim 2 wherein said monitoring device includes means for comparing a measured volume reduction in said pressure storing means with a normal value thereof, and means for issuing a signal in response to a determination by said comparing means that said measured volume reduction exceeds said normal value of volume reduction.

4. Assembly according to claim 2 wherein said determining and signaling means include an adjustable electrical time-limit relay for monitoring length of time of reduction of a volume of given size in said pressure storing means.

5. Device according to claim 1 wherein said load-applying device includes a volume regulator operatively connected to said pressure storing means and a pressure source connectible at switching intervals to said pressure storing means, and said determining and signaling means include a device for monitoring time portions of said switching intervals characteristic of rate of volume reduction of said pressure storing means.

* * * * *